US012672698B2

(12) United States Patent
Chou et al.

(10) Patent No.: US 12,672,698 B2
(45) Date of Patent: Jul. 7, 2026

(54) BLADDER FOR ARTICLE OF FOOTWEAR OR APPAREL

(71) Applicant: NIKE, Inc., Beaverton, OR (US)

(72) Inventors: Yi-Chen Chou, Taichung City (TW); Yen-Lin Lee, Taichung City (TW); Chih-Ta Chien, Meishan Township (TW); Chia-Chi Lin, Zhuqi Township (TW)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/734,885

(22) Filed: Jun. 5, 2024

(65) Prior Publication Data

US 2024/0407500 A1 Dec. 12, 2024

Related U.S. Application Data

(60) Provisional application No. 63/506,613, filed on Jun. 7, 2023.

(51) Int. Cl.
*A43B 13/20* (2006.01)

(52) U.S. Cl.
CPC ..... *A43B 13/20* (2013.01)

(58) Field of Classification Search
CPC ..... A43B 13/20; A43B 13/203; A43B 13/206; A43B 23/0285; A43B 23/029
See application file for complete search history.

(56) References Cited

U.S. PATENT DOCUMENTS

| | | | | |
|---|---|---|---|---|
| 3,462,330 | A * | 8/1969 | Greig | B29C 66/438 264/553 |
| 5,228,156 | A * | 7/1993 | Wang | A43B 21/28 36/35 B |
| 5,755,001 | A * | 5/1998 | Potter | A43B 21/28 12/146 B |
| 6,571,490 | B2 * | 6/2003 | Tawney | A43B 13/20 36/35 B |
| 7,950,169 | B2 | 5/2011 | Holt et al. | |
| 10,070,691 | B2 | 9/2018 | Greene | |
| 2022/0071352 | A1 * | 3/2022 | Case | A43B 13/188 |

(Continued)

FOREIGN PATENT DOCUMENTS

| | | | |
|---|---|---|---|
| CN | 112165881 | A | 1/2021 |
| CN | 113163898 | A | 7/2021 |
| EP | 3592168 | A1 | 1/2020 |

(Continued)

OTHER PUBLICATIONS

English translation of WO2012044137 (Year: 2012).*

(Continued)

*Primary Examiner* — Ted Kavanaugh
(74) *Attorney, Agent, or Firm* — Honigman LLP; Matthew H. Szalach

(57) ABSTRACT

A bladder for an article of footwear includes a first barrier having a first series of peaks and a first series of valleys, a second barrier having a second series of peaks and a second series of valleys, peaks of the second series of peaks being aligned with peaks of the first series of peaks and valleys of the second series of valleys being aligned with valleys of the first series of valleys, and a peripheral seam joining the first barrier and the second barrier to define an interior void.

20 Claims, 19 Drawing Sheets

(56) References Cited

U.S. PATENT DOCUMENTS

| | | | | |
|---|---|---|---|---|
| 2022/0330657 | A1* | 10/2022 | Bishop | A43B 23/029 |
| 2023/0033238 | A1* | 2/2023 | Hopkins | F04B 43/084 |

FOREIGN PATENT DOCUMENTS

| | | | | |
|---|---|---|---|---|
| WO | WO-2012044137 | A2 * | 4/2012 | A43B 3/30 |
| WO | WO-2022221499 | A1 * | 10/2022 | A43B 23/0235 |

OTHER PUBLICATIONS

European Patent Office (ISA), International Seach Report and Written Opinion for PCT App. No. PCT/2024/032761, mailed Sep. 20, 2024.

* cited by examiner

BLADDER FOR ARTICLE OF FOOTWEAR OR APPAREL

CROSS REFERENCE TO RELATED APPLICATIONS

This application claims priority under 35 U.S.C. § 119(e) to U.S. Provisional Application No. 63/506,613, filed on Jun. 7, 2023. The disclosure of this prior application is considered part of the disclosure of this application and is hereby incorporated by reference in its entirety.

FIELD

The present disclosure relates generally to a system and method for forming a bladder for an article of footwear and/or an article of apparel.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

While conventional uppers include structures such as laces, straps, and fasteners to secure an upper around a foot of a wearer, such conventional structures—while adequately securing the upper and, thus, the article of footwear, to a user's foot—do not generally conform the upper to the user's foot. Accordingly, a user's foot may be permitted to move relative to and within the upper of the article of footwear. Such relative movement between the foot and the upper results in relative movement between the foot and the sole structure. Accordingly, energy may be lost in running, jumping, banking, and other athletic movements due to the relative movement between the user's foot and the upper of the article of footwear, thereby resulting in inefficiencies during use.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
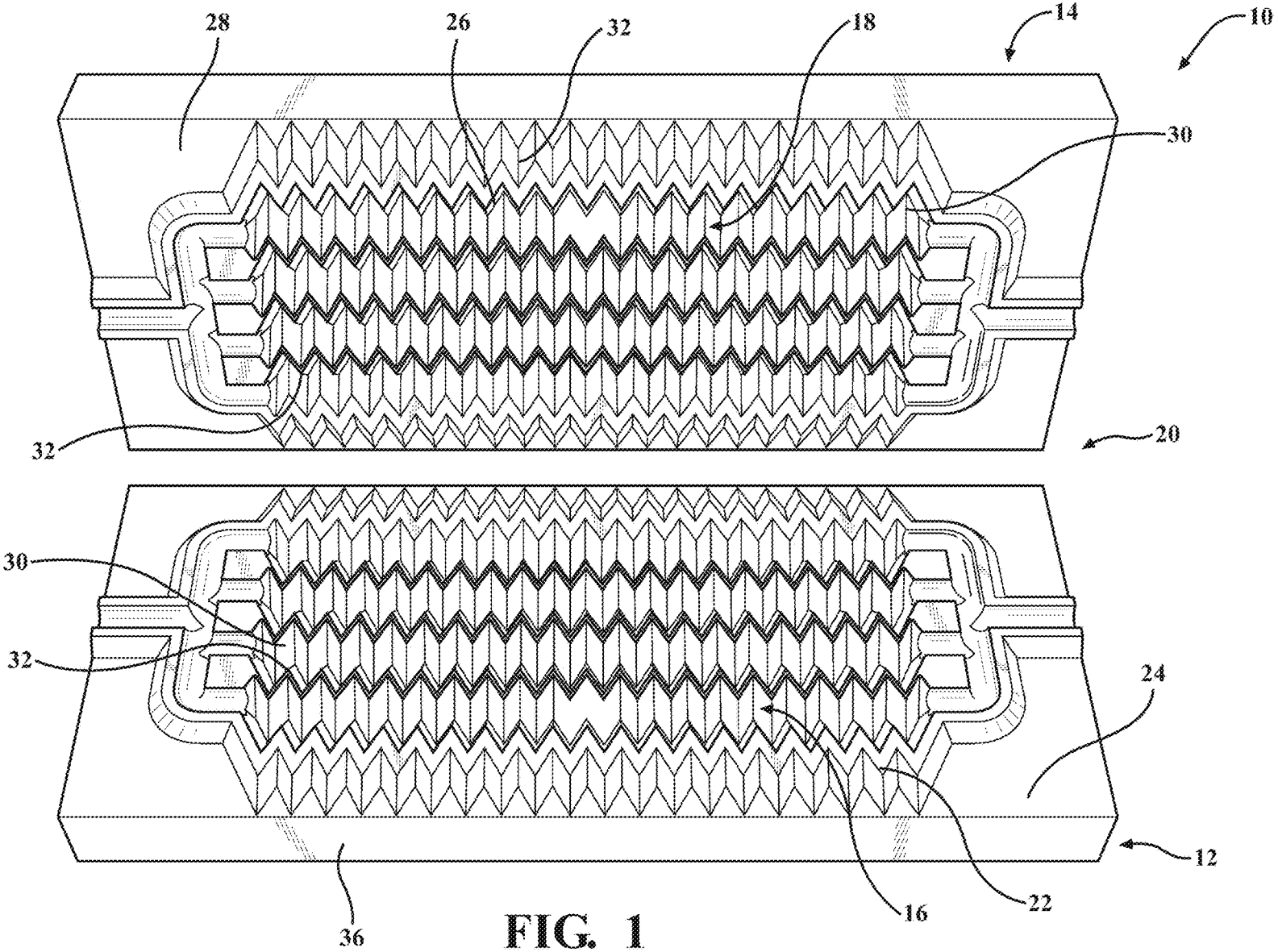
FIG. 1 is a perspective view of an example of a first mold and a second mold of a mold system according to the present disclosure.
Figure 2:
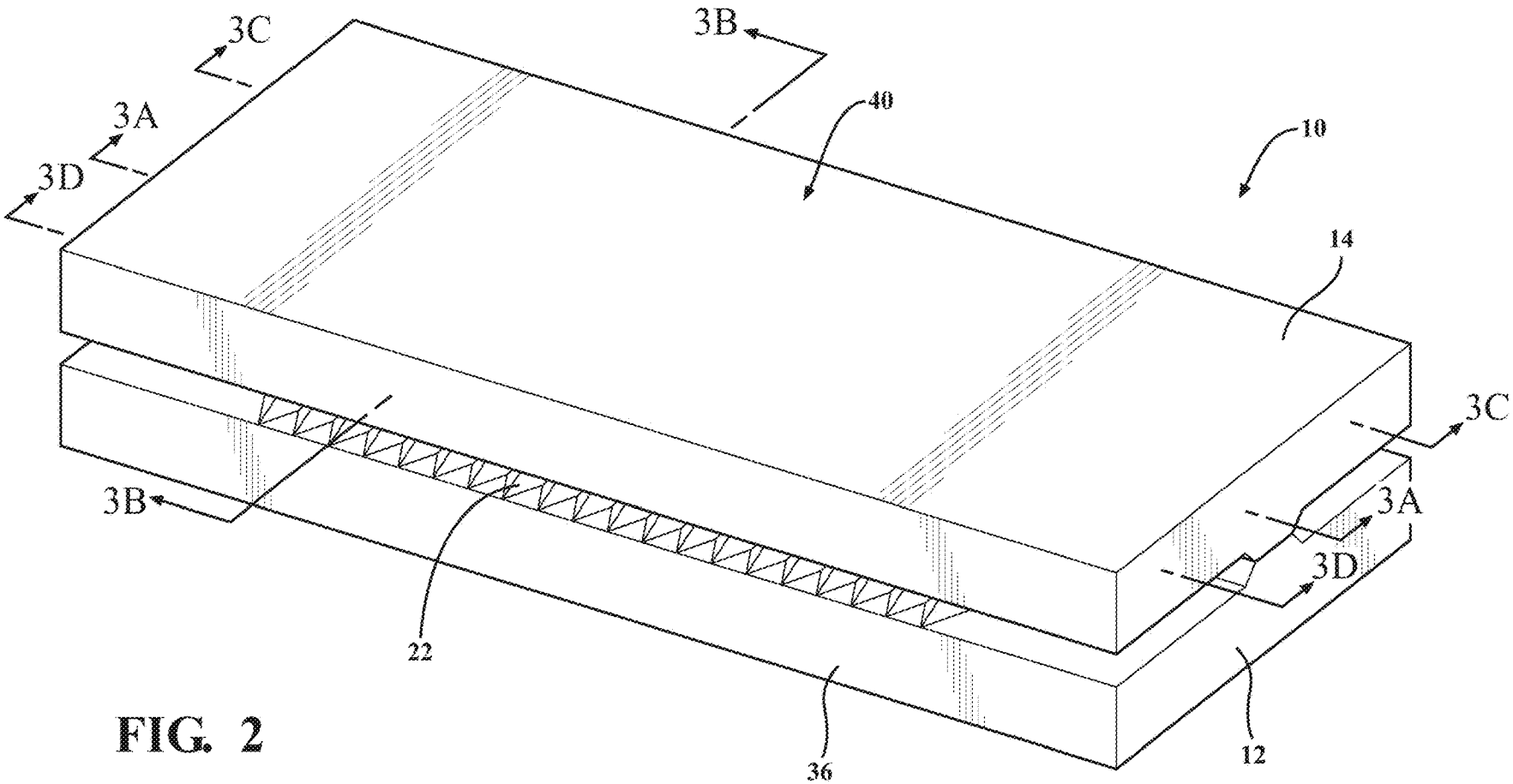
FIG. 2 is a perspective view of the second mold positioned on the first mold of the mold system according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a bladder for an article of footwear includes a first barrier having a first series of peaks and a first series of valleys, a second barrier having a second series of peaks and a second series of valleys, peaks of the second series of peaks being aligned with peaks of the first series of peaks and valleys of the second series of valleys being aligned with valleys of the first series of valleys, and a peripheral seam joining the first barrier and the second barrier to define an interior void.

The bladder may include one or more of the following optional features. For example, peaks of the first series of peaks may cooperate with peaks of the second series of peaks to provide the interior void with a series of cavities. Further, cavities of the series of cavities may include a diamond-shaped cross section. Additionally or alternatively, the bladder may be moveable between a relaxed state and a constricted state. The bladder may be moved from the relaxed state to the constricted state upon removal of fluid from the interior void. Adjacent peaks of the first series of peaks may move toward one another when the bladder is moved from the relaxed state to the constricted state and adjacent peaks of the second series of peaks may move toward one another when the bladder is moved from the relaxed state to the constricted state.

In one configuration, at least one weld may extend along a length of and may join the first barrier and the second barrier. The at least one weld may extend continuously from a first end of the bladder to a second end of the bladder.

Peaks of the first series of peaks may alternate with valleys of the first series of valleys along a length of the bladder and peaks of the second series of peaks may alternate with valleys of the second series of valleys along a length of the bladder. Further, each of the first barrier and the second barrier may include a Shore hardness of approximately 84A and a thickness of approximately 0.5 millimeters. Alternatively, each of the first barrier and the second barrier may include a Shore hardness of approximately 92A and a thickness of approximately 0.76 millimeters.

An article of footwear or apparel may incorporate the bladder described above.

In another configuration, a bladder for an article of footwear includes a first barrier having a first series of peaks and a first series of valleys, a second barrier having a second series of peaks and a second series of valleys, peaks of the second series of peaks cooperating with peaks of the first series of peaks to provide the bladder with an interior void having a series of diamond-shaped cavities, and a peripheral seam joining the first barrier and the second barrier.

The bladder may include one or more of the following optional features. For example, peaks of the first series of peaks may be aligned with respective peaks of the second series of peaks. Further, valleys of the first series of valleys may be aligned with respective valleys of the second series of valleys. Additionally or alternatively, the bladder may be moveable between a relaxed state and a constricted state. The bladder may be moved from the relaxed state to the constricted state upon removal of fluid from the interior void. Adjacent peaks of the first series of peaks may move toward one another when the bladder is moved from the relaxed state to the constricted state and adjacent peaks of the second series of peaks may move toward one another when the bladder is moved from the relaxed state to the constricted state.

In one configuration, at least one weld may extend along a length of and may join the first barrier and the second barrier. The at least one weld may extend continuously from a first end of the bladder to a second end of the bladder.

Peaks of the first series of peaks may alternate with valleys of the first series of valleys along a length of the bladder and peaks of the second series of peaks may alternate with valleys of the second series of valleys along a length of the bladder. Further, each of the first barrier and the second barrier may include a Shore hardness of approximately 84A and a thickness of approximately 0.5 millimeters. Alternatively, each of the first barrier and the second barrier may include a Shore hardness of approximately 92A and a thickness of approximately 0.76 millimeters.

An article of footwear or apparel may incorporate the bladder described above.

The details of one or more implementations of the disclosure are set forth in the accompanying drawings and the description below. Other aspects, features, and advantages will be apparent from the description, the drawings, and the claims.

With reference to FIGS. 1-4B, an example mold system 10 for molding a bladder 100 having a textured exterior surface is provided. The mold system 10 includes a first mold 12 and a second mold 14. The first mold 12 has one or more first mold cavities 16 and the second mold 14 has one or more second mold cavities 18 that each cooperate with a corresponding one of the first mold cavities 16 to define a respective mold chamber 20 that defines a shape and surface profile of the bladder 100. In the illustrated example, the first mold 12 includes a first pattern 22 formed along a first surface 24 and the second mold 14 includes a second pattern 26 formed along a second surface 28. The second pattern 26 cooperates with the first pattern 22 to form a configuration of the bladder 100 referred to as the bladder geometry 102. As described in more detail below, the bladder geometry 102 may have a generally zigzag configuration along at least a portion of a length $L_{100}$ of the bladder 100 with conduits 104 formed on a first end 106 and a second end 108 of the bladder 100.

The pattern 22 of the first mold 12 includes a plurality of recesses 30 located between a plurality of peaks 32 that may form, in one example, an undulating pattern 22 along the mold 12. The pattern 26 of the second mold 14 also includes the recesses 30 and the peaks 32 in a mirrored pattern relative to the first pattern 22, such that the peaks 32 of the first pattern 22 align with and abut the peaks 32 of the second pattern 26. As described in more detail below, the peaks 32 of the molds 12, 14 form depressions 110 in the bladder 100 while the recesses 30 of the molds 12, 14 receive portions of the bladder 100 to form ridges 112 along the bladder 100. It is further contemplated that one or both of the molds 12, 14 may include channels 34 formed along a base 36 of the molds 12, 14. For example, the first mold 12 is illustrated with the channels 34 disposed along the base 36 of the mold 12 and extending through to the first surface 24 of the mold 12. The mold 12 may be attached or otherwise coupled to a vacuum 200 configured to draw a vacuum during the formation of the bladder 100 through the channels 34. The mold 12 may be attached to the vacuum 200 via hoses, tubing, or any other practical duct system for drawing a vacuum within the first and second mold cavities 16, 18.

Figure 3A:
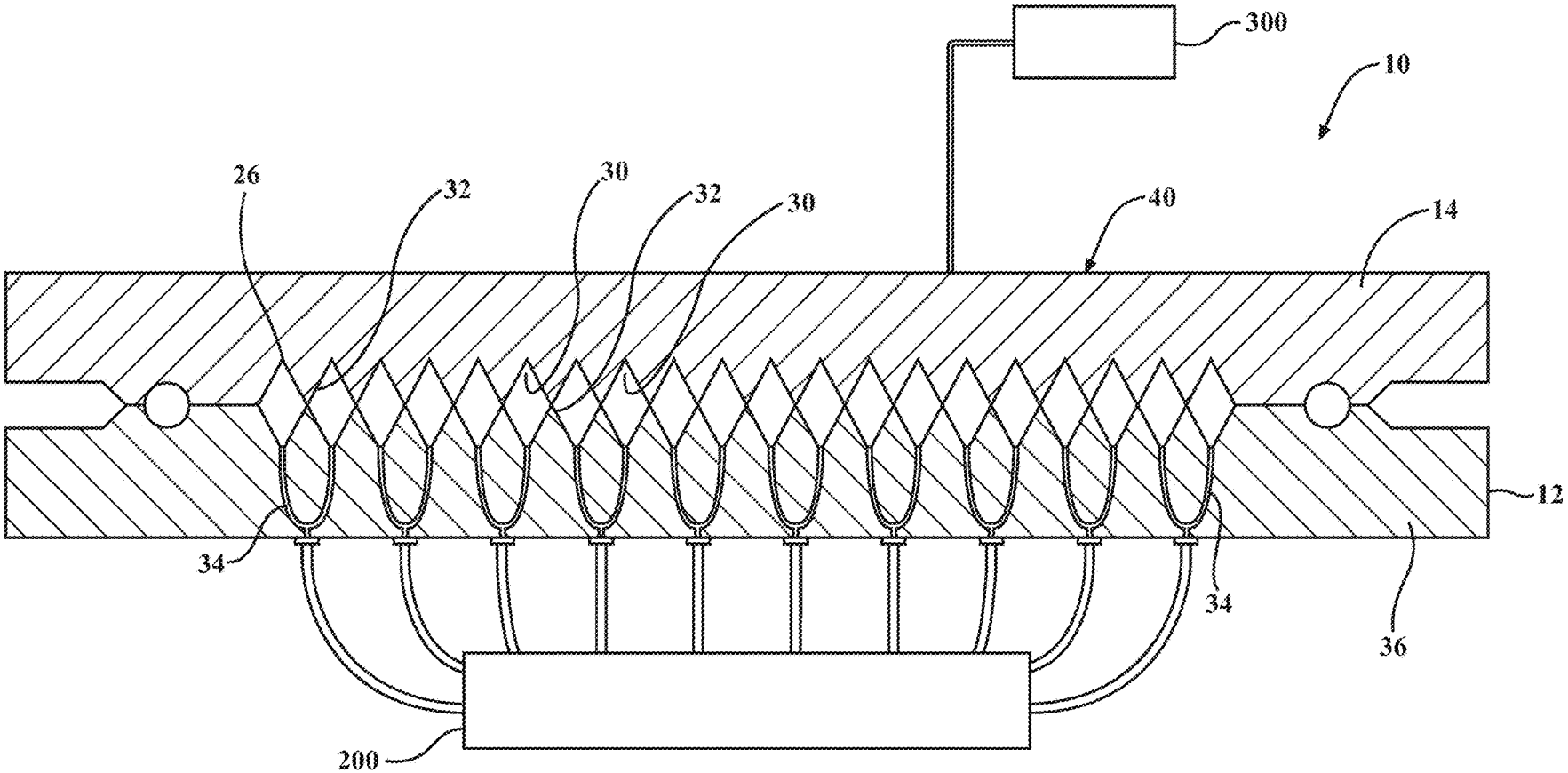
FIG. 3A is an example cross section of the mold system of FIG. 2 taken along Line 3A-3A in FIG. 2.
Figure 3B:
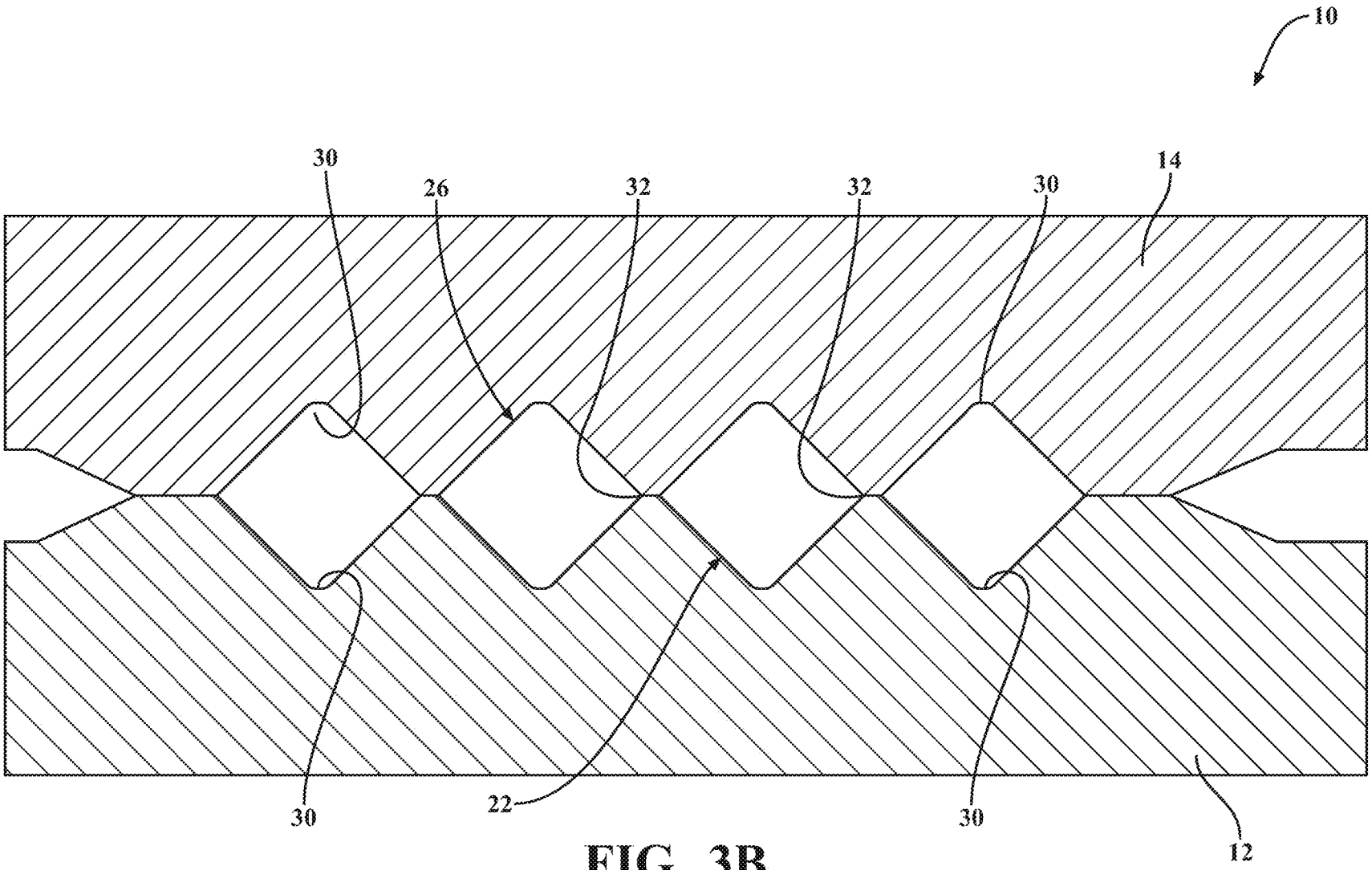
FIG. 3B is an example cross section of the mold system of FIG. 2 taken along Line 3B-3B in FIG. 2.
Figure 3C:
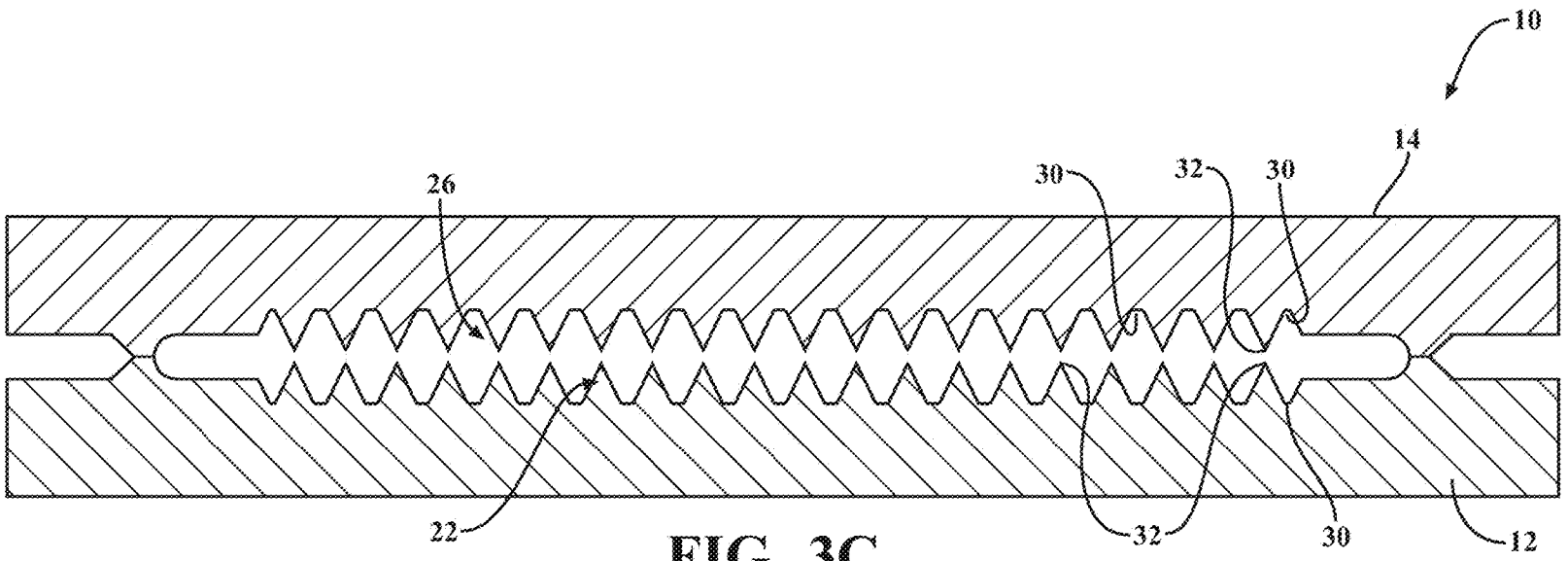
FIG. 3C is an example cross section of the mold system of FIG. 2 taken along Line 3C-3C in FIG. 2.
Figure 3D:
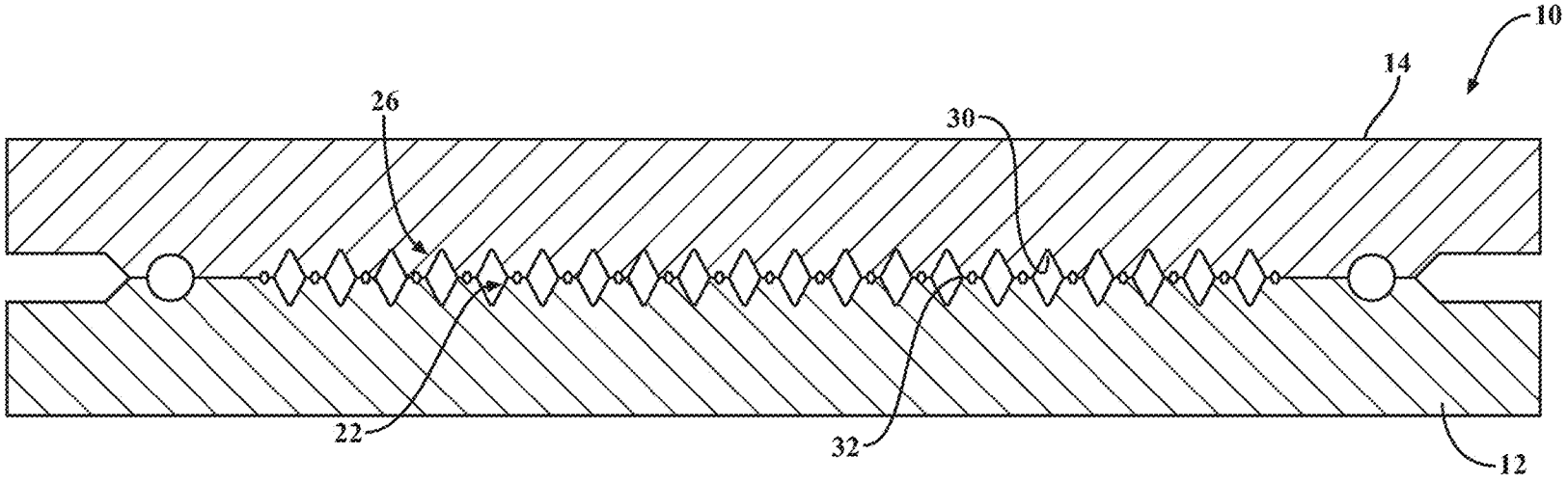
FIG. 3D is an example cross section of the mold system of FIG. 2 taken along Line 3D-3D in FIG. 2.
Figure 4A:
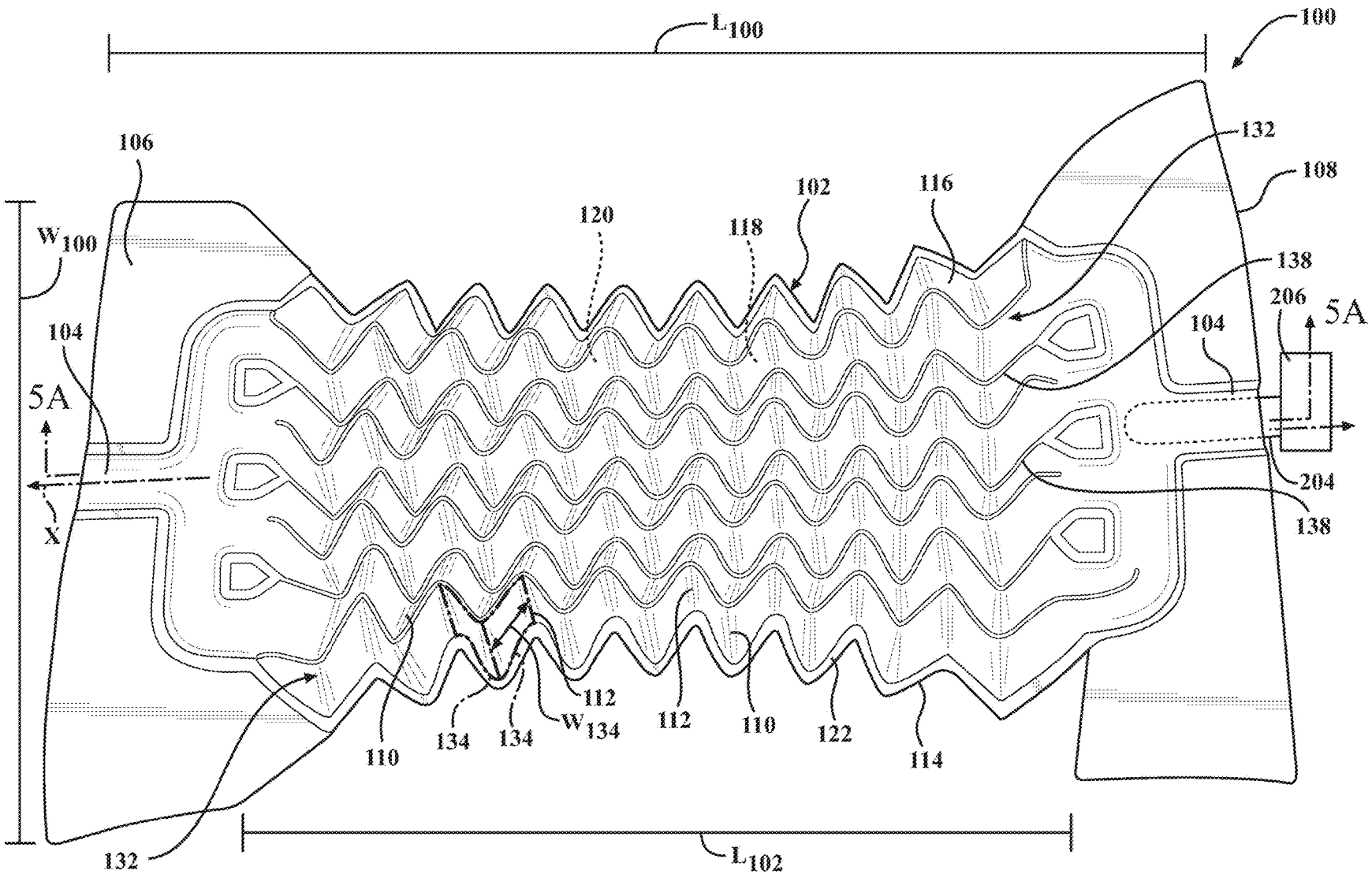
FIG. 4A is a perspective view of an example of a bladder in an expanded state according to the present disclosure.
Figure 4B:
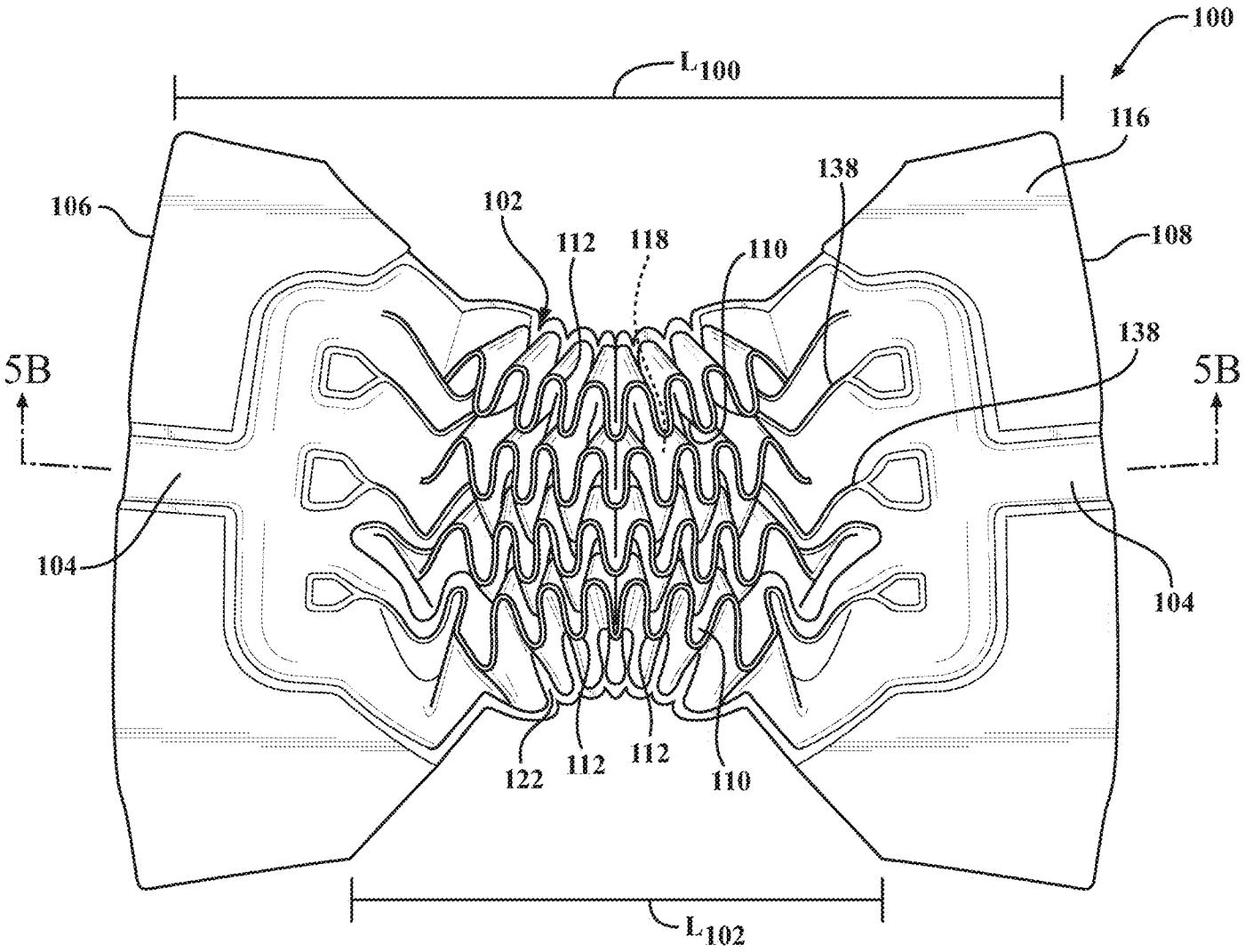
FIG. 4B is a perspective view of the bladder of FIG. 4A in a contracted state.

As illustrated in FIG. 3A, a heater 300 may be utilized in combination with the first and second molds 12, 14. It is contemplated that the heater 300 may preheat the molds 12, 14 to a desired temperature prior to formation of the bladder 100. By way of example, not limitation, the molds 12, 14 may be preheated to approximately 180 degrees Celsius for approximately two minutes. Additionally or alternatively, the molds 12, 14 may be preheated to a temperature approximately greater than 180 degrees Celsius or less than 180 degrees Celsius for a duration greater than two minutes or less than two minutes. The heater 300 may apply heat to an exterior 40 of the molds 12, 14, respectively, and/or may apply heat to the first and second surfaces 24, 28 of the mold cavities 16, 18. Heating the molds 12, 14 via the heater 300 may assist in the formation of the bladder 100, described below, by heating materials forming the bladder 100 to a desired temperature when disposed within the molds 12, 14. In operation, the applied heat softens the materials forming the bladder 100 when disposed within the molds 12, 14, thereby causing the materials to conform to the patterns 22, 26 of the molds 12, 14 and form the bladder 100.

Figure 5A:
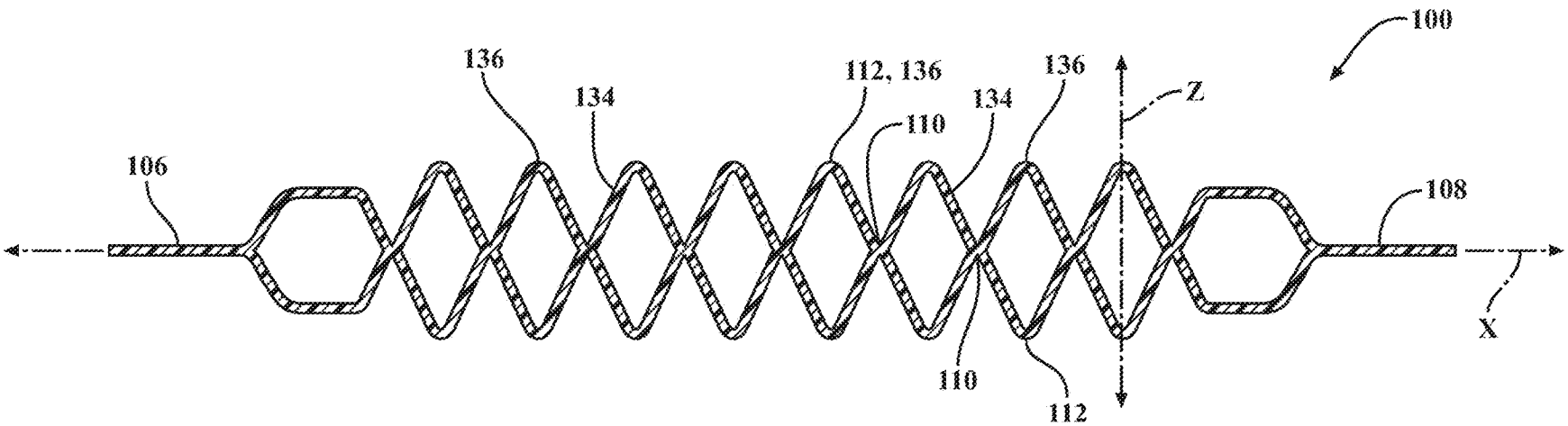
FIG. 5A is an example cross section of the bladder of FIG. 4A taken along Line 5A-5A in FIG. 4A.
Figure 5B:
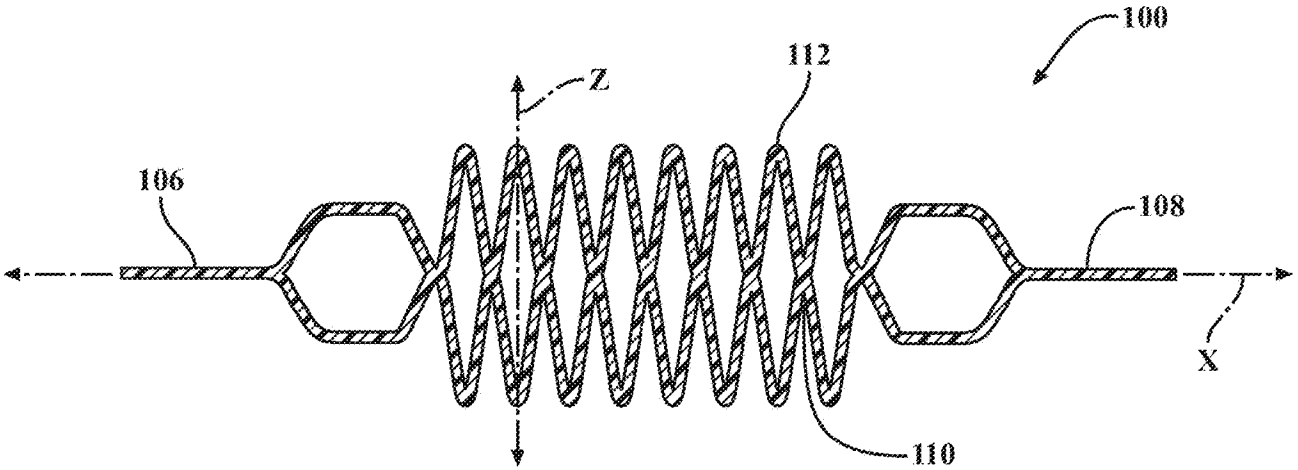
FIG. 5B is an example cross section of the bladder of FIG. 4B taken along Line 5B-5B in FIG. 4B.
Figure 6A:
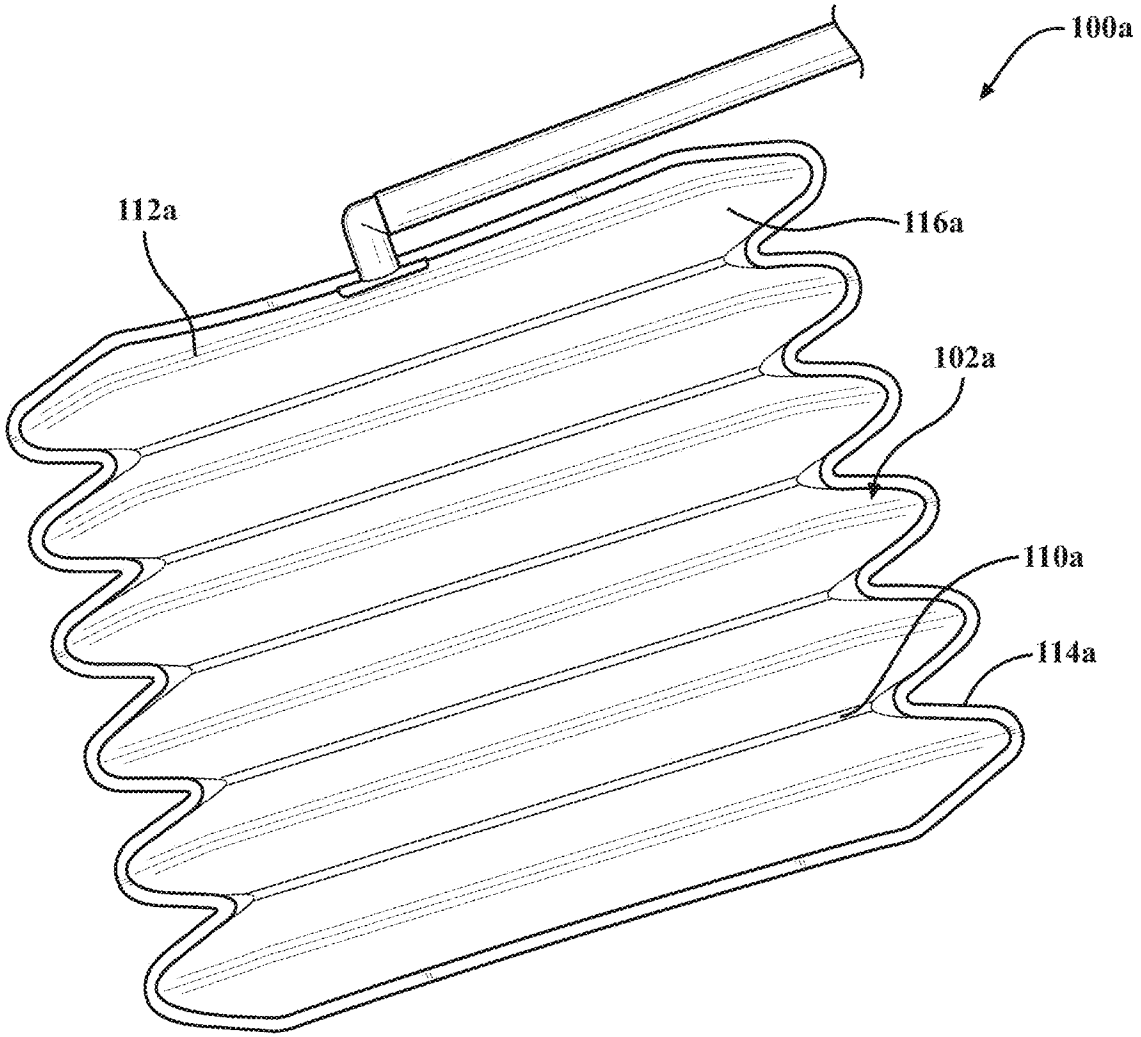
FIG. 6A is a perspective view of another example of a bladder in an expanded state according to the present disclosure.
Figure 6B:
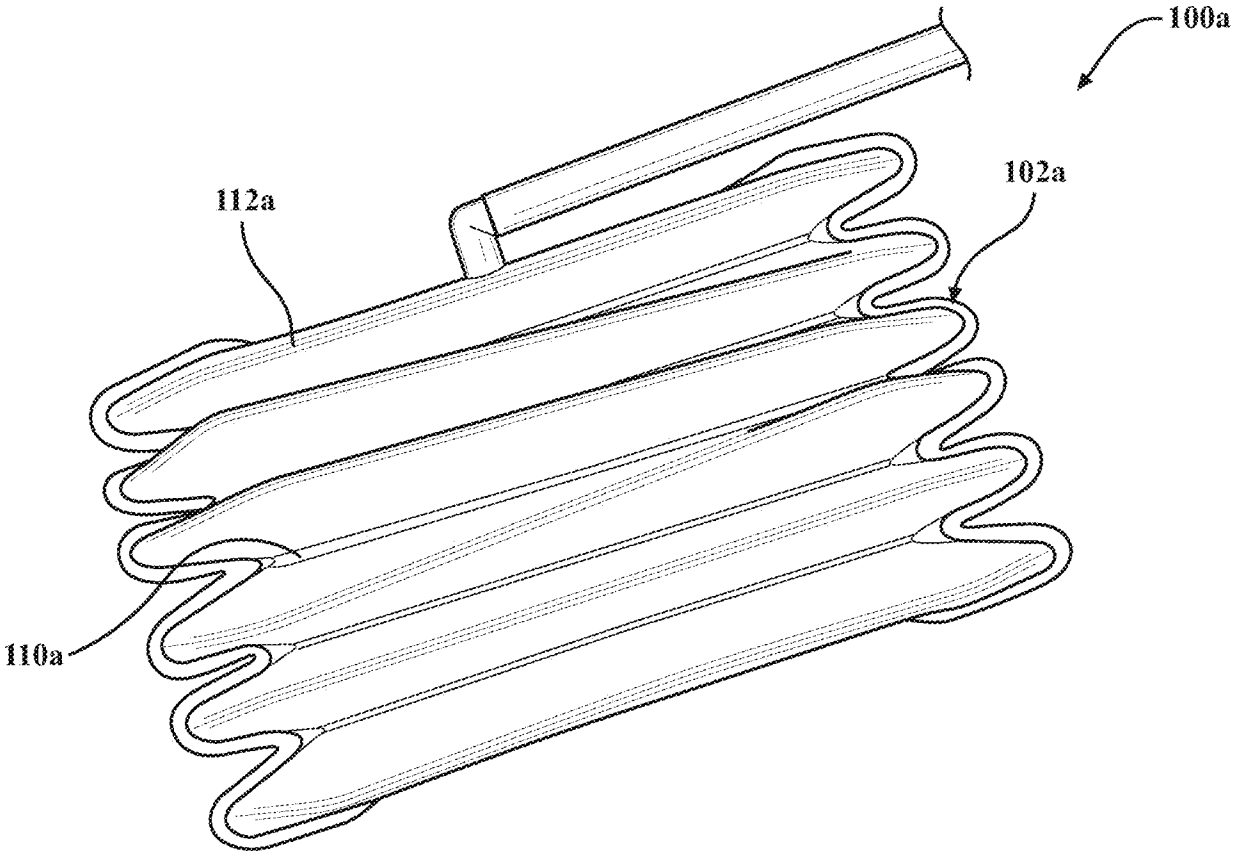
FIG. 6B is a perspective view of the bladder of FIG. 6B in a contracted state.
Figure 7A:
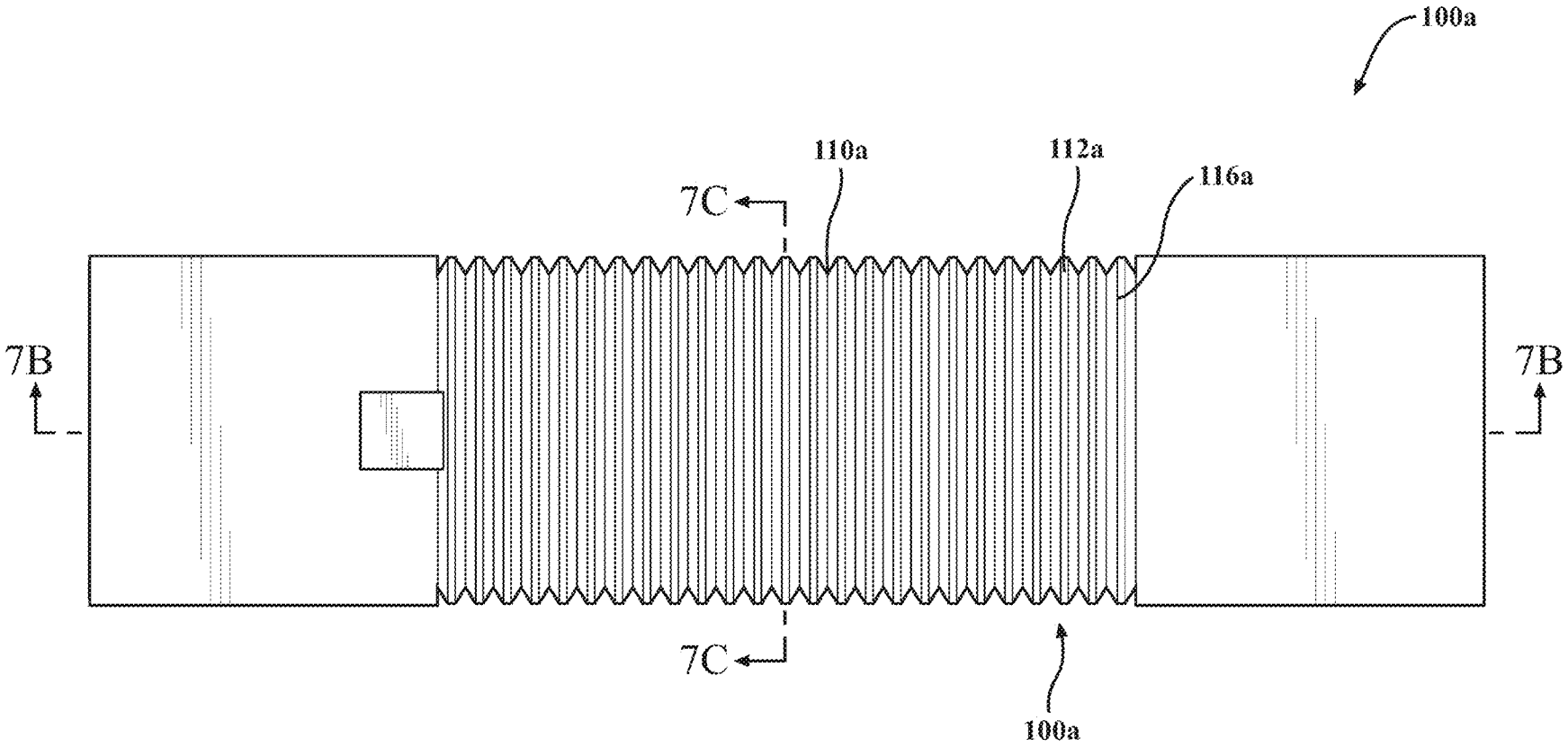
FIG. 7A is a top plan view of the bladder of FIG. 6A.
Figure 7B:
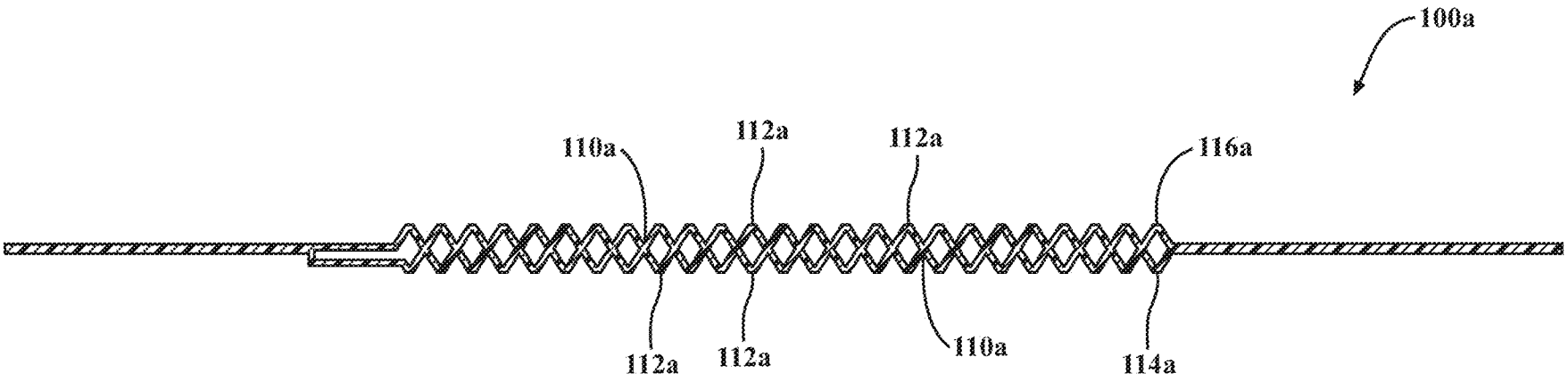
FIG. 7B is an example cross section of the bladder of FIG. 7A taken along Line 7B-7B in FIG. 7A.
Figure 7C:
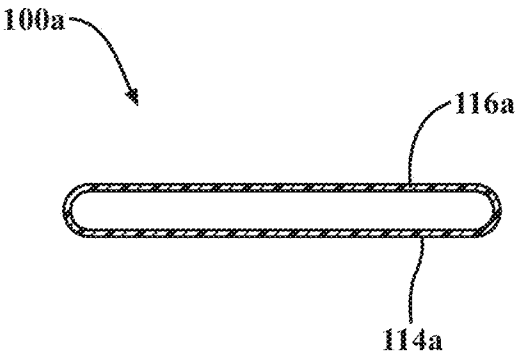
FIG. 7C is an example cross section of the bladder of FIG. 7A, taken along Line 7C-7C in FIG. 7A.
Figure 8:
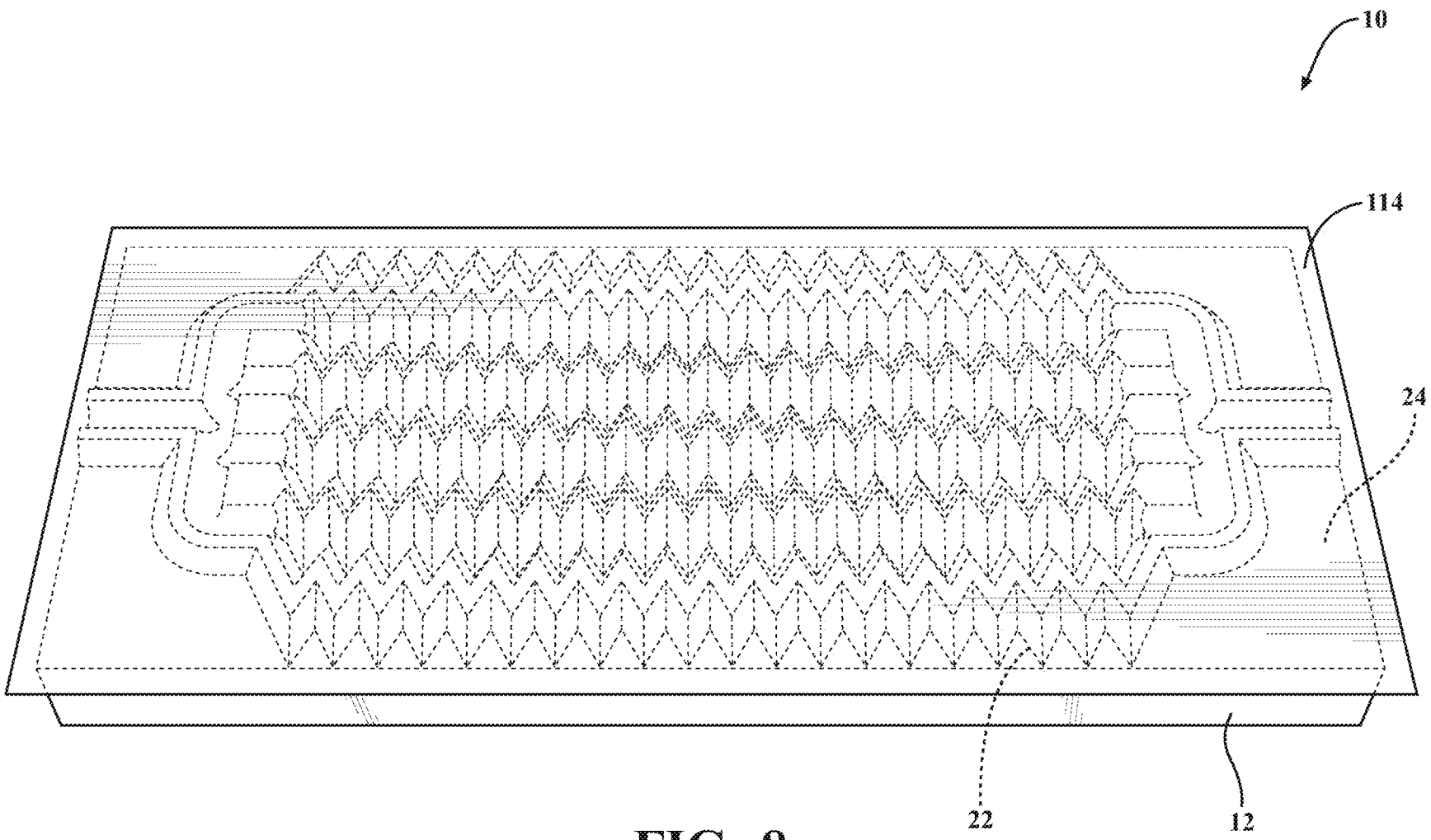
FIG. 8 is a perspective view of a first mold for a mold system with a first film according to the present disclosure.
Figure 9:
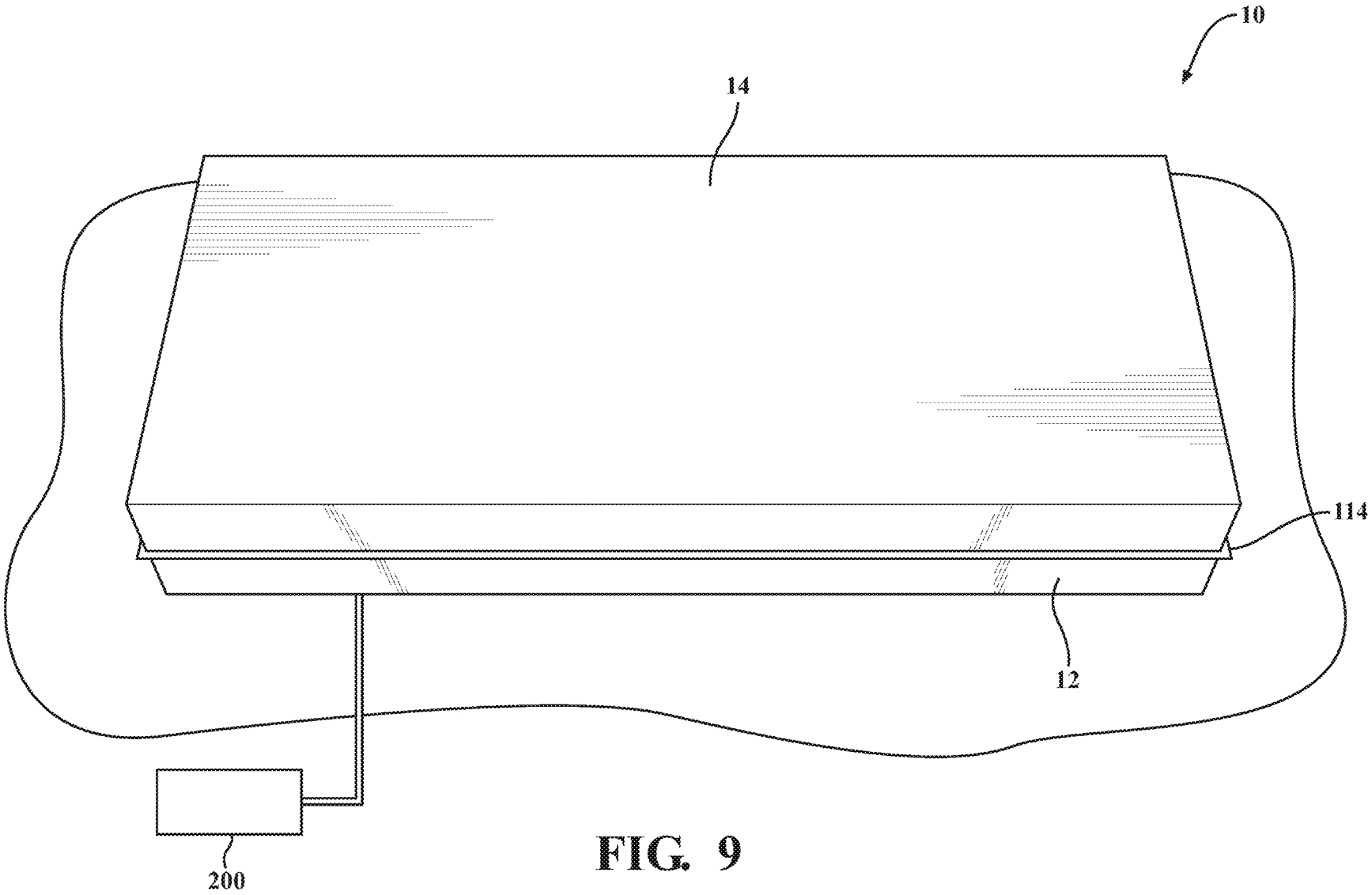
FIG. 9 is a perspective view of the mold system with the first film disposed between the first mold and an example second mold.
Figure 10:
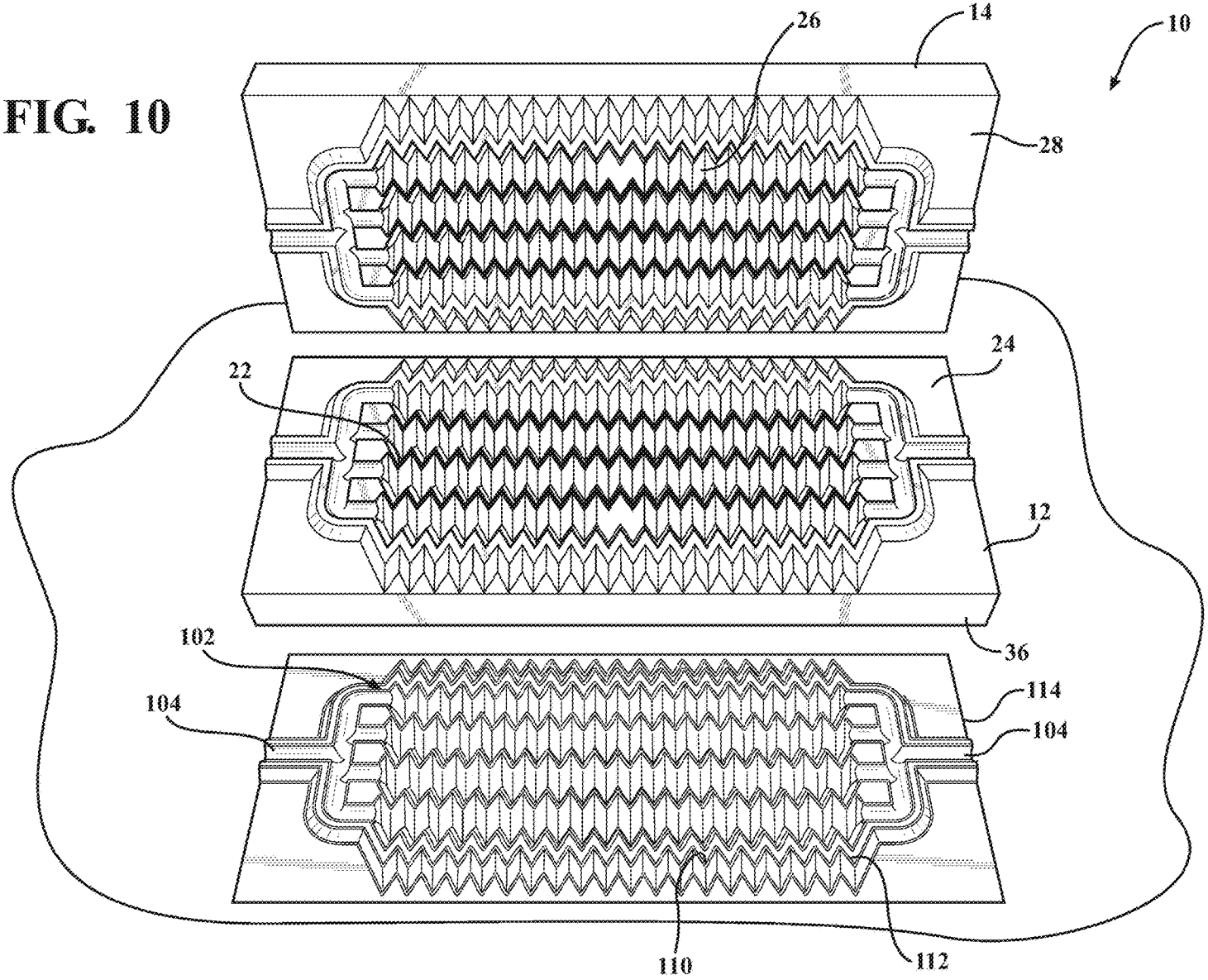
FIG. 10 is a perspective view of the mold system with an example first molded film.
Figure 11:
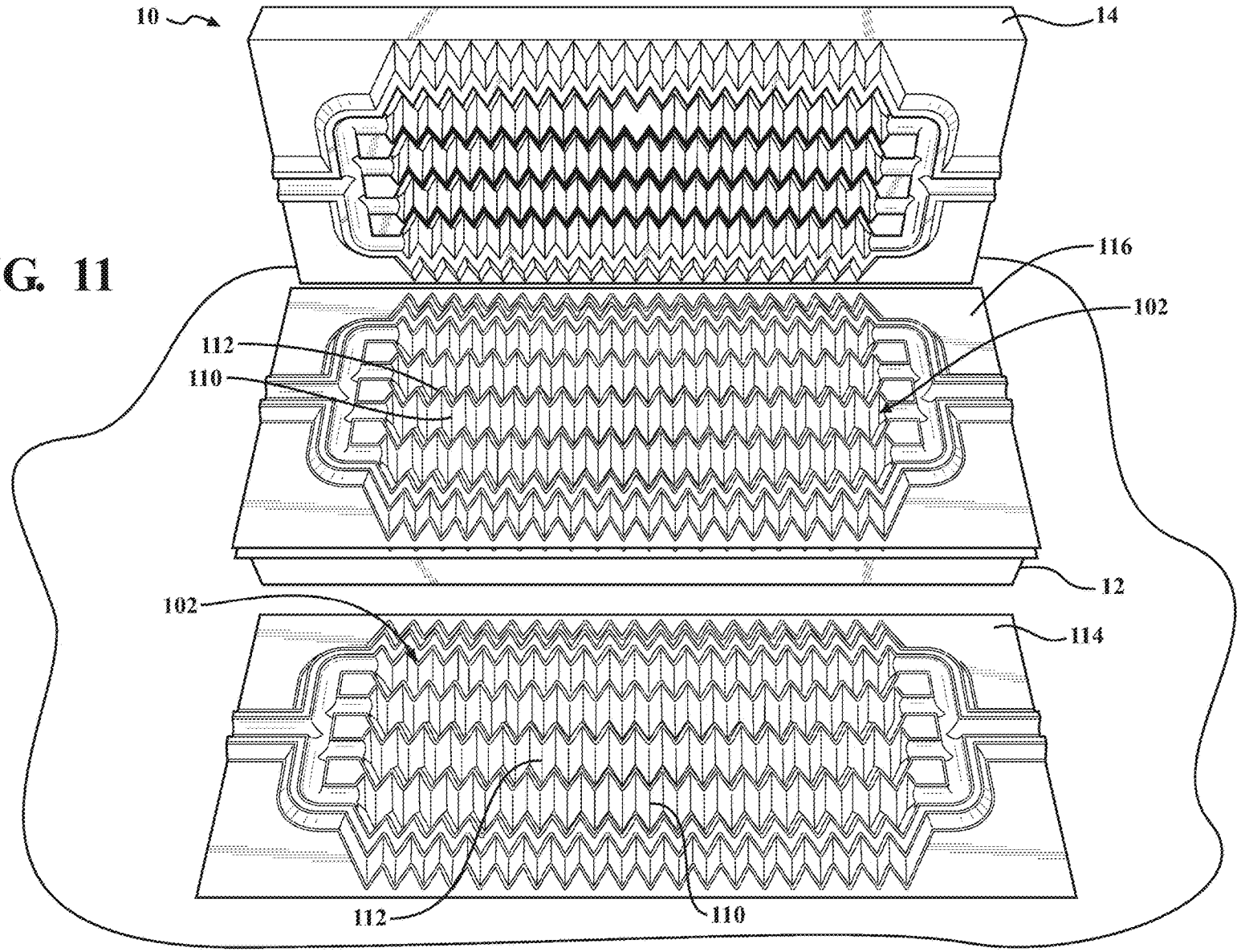
FIG. 11 is a perspective view of the mold system with the first molded film and an example second molded film.
Figure 12:
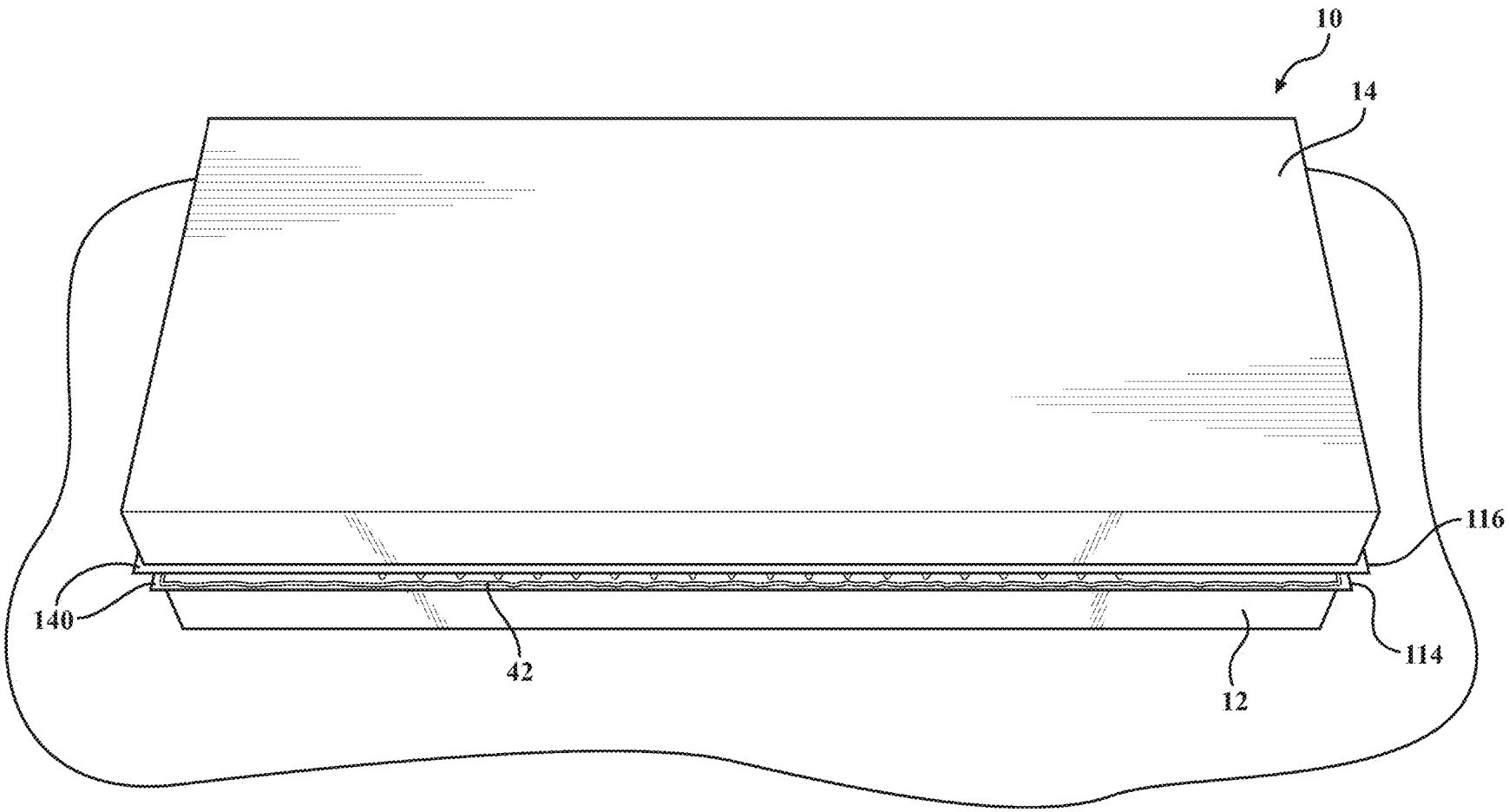
FIG. 12 is a perspective view of the mold system with the first molded film and the second molded film disposed between the first mold and the second mold.

With reference now to FIGS. 4A-5B the bladder 100 includes a first film or barrier layer 114 and a second film or barrier layer 116 that cooperate to define an interior void 118. The first barrier layer 114 is coupled to the second barrier layer 116 to form the interior void 118 of the bladder 100. FIGS. 5A and 5B illustrate cross-sectional views of an example of the bladder 100 transitioning from the relaxed state (FIG. 5A) taken along Line 5A-5A of FIG. 4A to the constricted state (FIG. 5B) taken along Line 5B-5B of FIG. 4B. Interior surfaces of the barrier layers 114, 116 face each other and are joined to each other to form a chamber 120 sealed by a peripheral seam 122 that surrounds the interior void 118 of the bladder 100. As described herein, the bladder 100 may be formed via a thermoforming process using the molds 12, 14 (FIG. 1). However, it is also contemplated that the bladder 100 may be formed via a blow-molding process, such that the bladder 100 may be free from the peripheral seam 122.

As used herein, the term "barrier layer" (e.g., barrier layers 114, 116) encompasses both monolayer and multilayer films. In some embodiments, one or both of barrier layers the 114, 116 are each produced (e.g., thermoformed or blow molded) from a monolayer film (a single layer). In other embodiments, one or both of the barrier layers 114, 116 are each produced (e.g., thermoformed or blow molded) from a multilayer film (multiple sublayers). In either aspect, each layer or sublayer can have a film thickness ranging from approximately 0.2 micrometers to approximately 1 millimeter. In further embodiments, the film thickness for each layer or sublayer can range from approximately 0.5 micrometers to approximately 500 micrometers. In yet further embodiments, the film thickness for each layer or sublayer can range from approximately 1 micrometer to approximately 100 micrometers. In one configuration, the barrier layers 114, 116 have a thickness of approximately 0.5 millimeters to approximately 0.7 millimeters. In another configuration, the barrier layers 114, 116 have a thickness of approximately 0.64 millimeters to approximately 0.76 millimeters.

One or both of the barrier layers 114, 116 can independently be transparent, translucent, and/or opaque. As used herein, the term "transparent" for a barrier layer means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 114, 116 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 114, 116 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 114, 116 include two or more sublayers, examples of suitable multilayer films include microlayer films, such as those disclosed in Bonk et al., U.S. Pat. No. 6,582,786, which is incorporated by reference in its entirety. In further embodiments, barrier layers 114, 116 may each independently include alternating sublayers of one or more TPU copolymer materials and one or more EVOH copolymer materials, where the total number of sublayers in each of the barrier layers 114, 116 includes at least four (4) sublayers, at least ten (10) sublayers, at least twenty (20) sublayers, at least forty (40) sublayers, and/or at least sixty (60) sublayers.

The chamber 120 can be produced from the barrier layers 114, 116 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 114, 116 can be produced by co-extrusion followed by vacuum thermoforming to produce the chamber 120.

In some embodiments, the chamber 120 has a gas transmission rate for nitrogen gas that is at least approximately ten (10) times lower than a nitrogen gas transmission rate for a butyl rubber layer of substantially the same dimensions. In an aspect, chamber 120 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 114, 116). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

Referring still to FIGS. 4A-5B, a hose 204 may be selectively and operably coupled to one of the conduits 104 at one end and coupled to a second vacuum 206 at an opposing end. The second vacuum 206 is configured to selectively draw a vacuum within the interior void 118 via the respective conduit 104 and a one-way valve may be positioned within the conduit 104 to maintain the vacuum drawn within the interior void 118. As mentioned above, the bladder geometry 102 contracts along the length $L_{100}$ of the bladder 100 as the vacuum is applied to the interior void 118 (i.e., fluid is removed from the interior void 118). As shown, the depressions 110 and the ridges 112 alternate along a length $L_{102}$ of the bladder geometry 102, which provides the bladder 100 with a waveform geometry along a length of the bladder 100. This waveform geometry causes the bladder 100 to collapse along its length into a folded structure, as shown in FIG. 4B when fluid is removed from the interior void 118. As shown in FIG. 4B, the collapsed structure is caused by adjacent ridges 112 being moved toward one another such that a volume of each depression 110 is reduced. This phenomenon is caused by air being removed from the interior void 118 when a vacuum is applied at one of the conduits 104.

It is also contemplated that multiple bladders 100 may be interconnected via the conduits 104 to form a series of bladders 100 with a vacuum being drawn through the conduits 104. The conduits 104 interconnecting the series of bladders 100 generally form an air tunnel across the bladders 100 through which the vacuum may be drawn. The conduits 104 may have a variable length depending on the placement of each respective bladder 100. For example, the bladders 100 may be incorporated with an article of footwear or apparel and may be positioned in different regions of the article to form various compressive regions of the article. The length of the conduits 104 may vary to interconnect the bladders 100 in each compressive region of the article and define a uniform compressive force in each compressive region when the vacuum is applied.

When the vacuum applied at the conduit 104 is removed, air is once again permitted to enter the interior void 118 via the conduit 104. Air is automatically drawn into the interior void 118 due to the shape of the bladder geometry 102 and the resilient material forming the bladder 100 upon removal of the vacuum. For example, the bladder geometry 102—due to the shape of the bladder 100 and the material forming the bladder 100—is biased into the expanded state. As such, when the vacuum is removed at the conduit 104, adjacent ridges 112 move away from one another due to the shape of the ridges 112, the shape of the depressions 110, and the resilient material forming the bladder 100. In so doing, the volume of the interior void 118 is increased and causes fluid to be drawn into the interior void 118.

The bladder geometry 102 includes deformation rows 132 that include the ridges 112 and the depressions 110. The deformation rows 132 also include stabilizing geometries 134 that cooperate to form the ridges 112. The configuration of the stabilizing geometries 134 may assist in the desired deformation of the bladder 100 under vacuum. For example, adjacent stabilizing geometries 134 apply opposing forces to prevent or at least minimize compressive deformation along the ridges 112 in a Z direction (FIG. 5A). Stated differently, the stabilizing geometries 134 cooperate to maintain the bladder geometry 102 in the expanded state and the contracted state of the bladder 100 and resist deflection to a planar state. In so doing, the stabilizing geometries 134 serve so ensure that the ridges 112 are maintained in the both the contracted state and the relaxed or expanded state even though the height of the ridges 112 may change.

The bladder 100 contracts along an x-axis (X) under vacuum (FIG. 5B) and along a z-axis (Z) when the vacuum is released (FIG. 5A). The stabilizing geometries 134 maintain the overall structure of the ridges 112 when the bladder 100 is in the expanded state and the contracted state. In so doing, the ridges 112 have a shorter length along the Z axis in the expanded state and a longer length along the Z axis in the contracted state but still maintain 112 a peak in both states.

The stabilizing geometries 134 are joined together at respective peaks 136 to form the ridges 112 and may provide a series of diamond-shaped voids along a length of the bladder 100 (FIG. 5A). The stabilizing geometries 134 are formed from the first and second patterns 22, 26 of the molds 12, 14, illustrated in FIG. 1, which may generally have a herringbone pattern. It is contemplated in one example that the stabilizing geometries 134 may have a width $W_{314}$ of approximately eight millimeters to approximately nine millimeters. Additionally or alternatively, the width $W_{314}$ may be greater than approximately nine millimeters or less than approximately eight millimeters, so long as the ratio to the z-axis (Z) is maintained. Stated differently, the width $W_{314}$ is configured as less than approximately ten millimeters in z-axis Z height.

In one configuration, the deformation rows 132 may be welded together to form internal welds or seams 138 along the length $L_{100}$ of the bladder 100. The internal seams 138 may provide added rigidity to the bladder 100 to assist in maintaining the bladder geometry 102 under vacuum. The internal seams 138 form a rigid portion of the bladder 100 that deforms into the adjacent depressions 110 as the bladder 100 contracts, such that the internal seams 138 assist in maintaining the height of the ridges 112 in the z-axis (Z) to prevent collapse or other structural change to the bladder geometry 102. For example, the vacuum 200 may be coupled to the bladder 100 to remove fluid from the interior void 118, thereby contracting along the x-axis (X) and constricting the internal seams 138 into the depressions 110 to provide additional support to the ridges 112. While the structure of the ridges 112 is configured to maintain the bladder geometry 102 under vacuum, the internal seams 138 may provide additional structural support for the ridges 112 to minimize potential collapse along the z-axis (Z). As shown, the internal seams 138 may extend uninterrupted along an entire length of the bladder 100 from a first end to a second end.

It is further contemplated that the barrier layers 114, 116 may be formed from a film having a thickness of approximately 0.76 millimeters to create a stiff or otherwise rigid shell of the bladder. It is also contemplated that the thickness of the barrier layers 114, 116 may be approximately 0.5 millimeters, 0.64 millimeters, or 0.7 millimeters. Additionally or alternatively, the thickness of the barrier layers 114, 116 may be less than approximately 0.5 millimeters or greater than approximately 0.76 millimeters. It is contemplated that the thickness of the barrier layers 114, 116 may vary depending on other characteristics of the bladder 100 including, but not limited to, the length $L_{100}$ and width $W_{100}$. The barrier layers 114, 116 are configured to contract at a faster rate along the x-axis (X), such that the length $L_{100}$ of the bladder 100 reduces at a faster rate as compared to a height of the bladder 100. It is further contemplated that the barrier layers 114, 116 are generally thinner at the ridges 112 as compared to the depressions 110, which assists in contraction of the bladder 100.

For example, the ridges 112 may function as a hinge, such that the first and second barrier layers 114, 116 hinge at the ridges 112 and generally compress the depressions 110 defined therebetween. The ridges 112 may be formed as living hinges, such that the ridges 112 may flex with the expansion and retract with the contraction of the bladder 100, but generally return to the original shape of the ridges 112 in a relaxed state of the bladder 100. In operation, the first and second barrier layers 114, 116 are formed from a material that maintains a degree of rigidity under the applied vacuum, such that the plurality of ridges 112 remain elevated or otherwise raised relative to the depressions 110 under the applied vacuum. For example, the rigidity of the barrier layers 114, 116 may depend on the Shore hardness of the respective TPU material used to form the barrier layers 114, 116. In one aspect, the barrier layers 114, 116 are formed from a TPU material having a Shore hardness of approximately 84A to approximately 88A. In another example, the barrier layers 114, 116 may be formed from a TPU material having a Shore hardness of approximately 91A to approximately 92A. In contrast, alternate geometries may result in total compression of the ridges 112 when a vacuum is applied to the bladder 100. Stated differently, the bladder geometry 102 significantly impacts the structural integrity of the bladder 100 under the applied vacuum by maintaining the ridges 112.

Referring to FIGS. 6A-7C, a bladder 100*a* is provided. In view of the substantial similarity in structure and function of the components associated with the bladder 100, like reference numerals are used hereinafter and in the drawings to identify like components while like reference numerals containing letter extensions are used to identify those components that have been modified. The bladder 100*a* may be formed using a similar process to the method described above with respect to the bladder 100.

The bladder 100*a* includes a first film or barrier layer 114*a* and a second film or barrier layer 116*a* that cooperate to define an interior void 118. The first barrier layer 114*a* is coupled to the second barrier layer 116*a* to form the interior void 118 of the bladder 100*a*. Both of the first and second barrier layers 114*a*, 116*a* include ridges 112*a* formed along a length $L_{100a}$ of the bladder 100*a* with depressions 110*a* formed between each of the ridges 112*a*. In this configuration, the ridges 112*a* are formed in a parallel configuration, such that each ridge 112*a* is parallel to an adjacent ridge 112*a* with a depression 110*a* disposed therebetween. The ridges 112*a* and the depressions 110*a* form a bladder geometry 102*a* of the bladder 100*a* that cooperates to retain the structure of the bladder 100*a* during compression and expansion of the bladder 100*a*. For example, the bladder 100*a* is operable between an expanded state and a contracted state, and the ridges 112*a* assist in maintaining the general shape of the bladder 100*a* in the contracted state and the expanded state to prevent collapse of the bladder 100*a* during expansion and contraction.

Referring to FIGS. 8-12, a method of forming a bladder 100 using an example of a mold system 10 according to the present disclosure is provided. In one step, a first mold 12 and a second mold 14 are preheated. The first mold 12 includes a first surface 24 with a first pattern 22 formed along the first surface 24, and the second mold 14 includes a second surface 28 with a second pattern 26 formed along the second surface 28. A first film 114 is positioned along the preheated first mold 12. A first vacuum is applied to the first film 114 along the heated first mold 12, and the heated second mold 14 is positioned on the first film 114. While the first vacuum is applied, the first mold 12 and the first film 114 are heated to approximately 170 degrees Celsius, and the vacuum is drawn at approximately 145 mmHg for 90 minutes and then at approximately 700 mmHg for approximately 30 minutes. The first vacuum may then be momentarily released from the first mold 12 while the second mold 14 is positioned over the first mold 12 and the first film 114. A first positive pressure from the second mold 14 is applied along the first film 114 to form a first molded film 114 of the bladder 100. The vacuum is applied again at approximately 700 mmHg. The molds 12, 14 and the first film 114 are then cooled to approximately 60 degrees Celsius to approximately 70 degrees Celsius after ten minutes. These steps are then repeated to form a second molded film 116 of the bladder 100.

The first molded film 114 is then positioned on the first mold 12, and an adhesive 42 is disposed around a perimeter 140 of the first molded film 114. The second molded film 116 also includes the adhesive 42 around a perimeter 140, and the second molded film 116 is positioned on the first molded film 114. The second mold 14 is positioned over both the first and second molded films 114, 116 and the first mold 12, and a positive pressure is applied. For example, the second mold 14 may be clamped or otherwise secured to the first mold 12. The first and second films 114, 116 are molded together using high frequency welding at approximately 130 degrees Celsius to seal the adhesive 42 around the perimeters 140 to form a peripheral seam 122 of the bladder 100. Once the peripheral seam 122 is sealed, an interior void 118 of the bladder 100 is formed, which assists in the expansion and contraction of the bladder 100. Although described with respect to the bladder 100, it is contemplated that the method may also be used to form the bladder 100*a*.

Figure 13A:
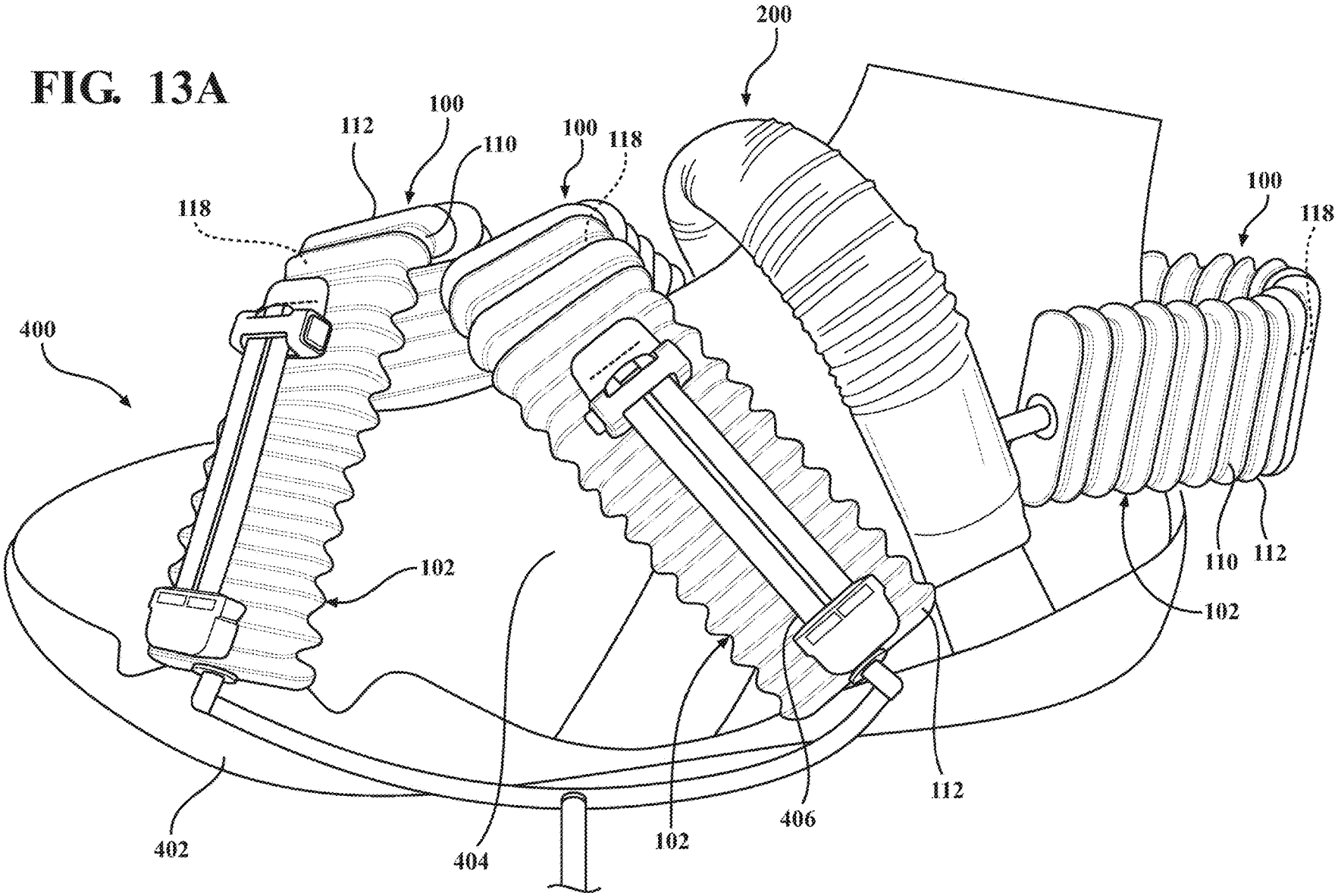
FIG. 13A is an example of an article of footwear including bladders according to the present disclosure, the bladders each in an expanded state.
Figure 13B:
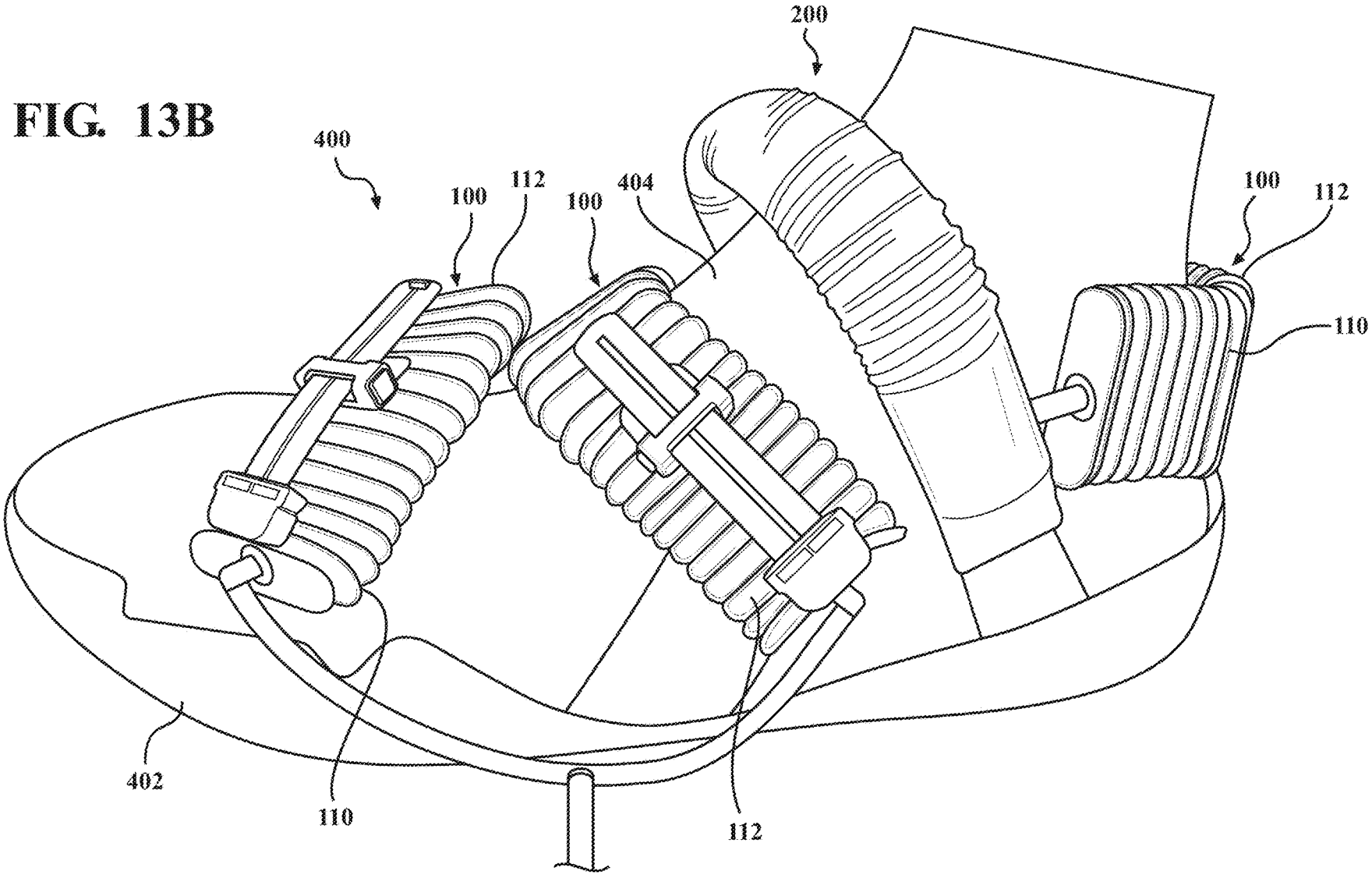
FIG. 13B is an example of the article of footwear of FIG. 13A with the bladders each in a contracted state.

FIGS. 13A and 13B show an example of an article of footwear 400 including the bladder 100. However, the principles of the present disclosure may be used for forming bladders used in other parts of the article of footwear, such as in a forefoot region or midfoot region of a sole structure 402 or along an upper 404 of the article of footwear 400. It is further contemplated that the bladder 100 may be incorporated in a portion of the upper 404 and/or a strap 406 extending across the upper 404. Further, such a bladder may be incorporated into an article of apparel or equipment (neither shown) to secure the apparel to equipment to a user. For example, the bladders 100, 100*a* could be used in a bra to secure the bra around a torso of a wearer and may be used in a bag or backpack to secure the bag or backpack to a wearer and/or to secure contents disposed within the bag or backpack.

The following Clauses provide an exemplary configuration for a method of forming a fluid-filled chamber for an article of footwear or apparel described above.

Clause 1. A bladder for an article of footwear, the bladder comprising a first barrier including a first series of peaks and a first series of valleys, a second barrier including a second series of peaks and a second series of valleys, peaks of the second series of peaks being aligned with peaks of the first series of peaks and valleys of the second series of valleys being aligned with valleys of the first series of valleys, and a peripheral seam joining the first barrier and the second barrier to define an interior void.

Clause 2. The bladder of Clause 1, wherein peaks of the first series of peaks cooperate with peaks of the second series of peaks to provide the interior void with a series of cavities.

Clause 3. The bladder of Clause 2, wherein cavities of the series of cavities include a diamond-shaped cross section.

Clause 4. The bladder of any of the preceding Clauses, wherein the bladder is moveable between a relaxed state and a constricted state.

Clause 5. The bladder of Clause 4, wherein the bladder is moved from the relaxed state to the constricted state upon removal of fluid from the interior void.

Clause 6. The bladder of Clause 4, wherein adjacent peaks of the first series of peaks move toward one another when the bladder is moved from the relaxed state to the constricted state and adjacent peaks of the second series of peaks move toward one another when the bladder is moved from the relaxed state to the constricted state.

Clause 7. The bladder of any of the preceding Clauses, further comprising at least one weld extending along a length of and joining the first barrier and the second barrier.

Clause 8. The bladder of Clause 7, wherein the at least one weld extends continuously from a first end of the bladder to a second end of the bladder.

Clause 9. The bladder of any of the preceding Clauses, wherein peaks of the first series of peaks alternate with valleys of the first series of valleys along a length of the bladder and peaks of the second series of peaks alternate with valleys of the second series of valleys along a length of the bladder.

Clause 10. The bladder of any of the preceding Clauses, wherein each of the first barrier and the second barrier has a Shore hardness of approximately 84A and a thickness of approximately 0.5 millimeters.

Clause 11. The bladder of any of Clauses 1-9, wherein each of the first barrier and the second barrier has a Shore hardness of approximately 92A and a thickness of approximately 0.76 millimeters.

Clause 12. An article of footwear incorporating the bladder of any of the preceding Clauses.

Clause 13. A bladder for an article of footwear, the bladder comprising a first barrier including a first series of peaks and a first series of valleys, a second barrier including a second series of peaks and a second series of valleys, peaks of the second series of peaks cooperating with peaks of the first series of peaks to provide the bladder with an interior void having a series of diamond-shaped cavities, and a peripheral seam joining the first barrier and the second barrier.

Clause 14. The bladder of Clause 13, wherein peaks of the first series of peaks are aligned with respective peaks of the second series of peaks.

Clause 15. The bladder of Clause 14, wherein valleys of the first series of valleys are aligned with respective valleys of the second series of valleys.

Clause 16. The bladder of any of the preceding Clauses, wherein the bladder is moveable between a relaxed state and a constricted state.

Clause 17. The bladder of Clause 16, wherein the bladder is moved from the relaxed state to the constricted state upon removal of fluid from the interior void.

Clause 18. The bladder of Clause 16, wherein adjacent peaks of the first series of peaks move toward one another when the bladder is moved from the relaxed state to the constricted state and adjacent peaks of the second series of peaks move toward one another when the bladder is moved from the relaxed state to the constricted state.

Clause 19. The bladder of any of the preceding Clauses, further comprising at least one weld extending along a length of and joining the first barrier and the second barrier.

Clause 20. The bladder of Clause 19, wherein the at least one weld extends continuously from a first end of the bladder to a second end of the bladder.

Clause 21. The bladder of any of the preceding Clauses, wherein peaks of the first series of peaks alternate with valleys of the first series of valleys along a length of the bladder and peaks of the second series of peaks alternate with valleys of the second series of valleys along a length of the bladder.

Clause 22. The bladder of any of the preceding Clauses, wherein each of the first barrier and the second barrier has a Shore hardness of approximately 84A and a thickness of approximately 0.5 millimeters.

Clause 23. The bladder of any of Clauses 13-21, wherein each of the first barrier and the second barrier has a Shore hardness of approximately 92A and a thickness of approximately 0.76 millimeters.

Clause 24. An article of footwear incorporating the bladder of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A bladder for an article of footwear, the bladder comprising:

a first barrier including a first series of peaks and a first series of valleys;

a second barrier including a second series of peaks and a second series of valleys, peaks of the second series of peaks being aligned with peaks of the first series of peaks and valleys of the second series of valleys being aligned with valleys of the first series of valleys, the first barrier and the second barrier being operable between an expanded state and a contracted state and the peaks of each of the first series of peaks and the second series of peaks being maintained in both the expanded state and the contracted state; and a peripheral seam joining the first barrier and the second barrier to define an interior void free of internal structures.

2. The bladder of claim 1, wherein peaks of the first series of peaks cooperate with peaks of the second series of peaks to provide the interior void with a series of cavities.

3. The bladder of claim 2, wherein cavities of the series of cavities include a diamond-shaped cross section.

4. The bladder of claim 1, wherein the bladder is moveable between a relaxed state and a constricted state.

5. The bladder of claim 4, wherein the bladder is moved from the relaxed state to the constricted state upon removal of fluid from the interior void.

6. The bladder of claim 4, wherein adjacent peaks of the first series of peaks move toward one another when the bladder is moved from the relaxed state to the constricted state and adjacent peaks of the second series of peaks move toward one another when the bladder is moved from the relaxed state to the constricted state.

7. The bladder of claim 1, further comprising at least one weld extending along a length of and joining the first barrier and the second barrier.

8. The bladder of claim 7, wherein the at least one weld extends continuously from a first end of the bladder to a second end of the bladder.

9. The bladder of claim 1, wherein peaks of the first series of peaks alternate with valleys of the first series of valleys along a length of the bladder and peaks of the second series of peaks alternate with valleys of the second series of valleys along a length of the bladder.

10. An article of footwear incorporating the bladder of claim 1.

11. A bladder for an article of footwear, the bladder comprising:

a first barrier including a first series of peaks and a first series of valleys;

a second barrier including a second series of peaks and a second series of valleys, the first barrier and the second barrier being operable between an expanded state and a contracted state and the peaks of each of the first series of peaks and the second series of peaks being maintained in both the expanded state and the contracted state, the peaks of the second series of peaks cooperating with the peaks of the first series of peaks to provide the bladder with an interior void having a series of diamond-shaped cavities and being free of internal structures; and a peripheral seam joining the first barrier and the second barrier.

12. The bladder of claim 11, wherein peaks of the first series of peaks are aligned with respective peaks of the second series of peaks.

13. The bladder of claim 12, wherein valleys of the first series of valleys are aligned with respective valleys of the second series of valleys.

14. The bladder of claim 11, wherein the bladder is moveable between a relaxed state and a constricted state.

15. The bladder of claim 14, wherein the bladder is moved from the relaxed state to the constricted state upon removal of fluid from the interior void.

16. The bladder of claim 14, wherein adjacent peaks of the first series of peaks move toward one another when the bladder is moved from the relaxed state to the constricted state and adjacent peaks of the second series of peaks move toward one another when the bladder is moved from the relaxed state to the constricted state.

17. The bladder of claim 11, further comprising at least one weld extending along a length of and joining the first barrier and the second barrier.

18. The bladder of claim 17, wherein the at least one weld extends continuously from a first end of the bladder to a second end of the bladder.

19. The bladder of claim 11, wherein peaks of the first series of peaks alternate with valleys of the first series of valleys along a length of the bladder and peaks of the second series of peaks alternate with valleys of the second series of valleys along a length of the bladder.

20. An article of footwear incorporating the bladder of claim 11.

* * * * *